US005332636A

United States Patent [19]

Ong

[11] Patent Number: 5,332,636

[45] Date of Patent: Jul. 26, 1994

[54] TONER COMPOSITIONS WITH ALUMINUM NEGATIVE CHARGE ENHANCING ADDITIVES

[75] Inventor: Beng S. Ong, Mississauga, Canada

[73] Assignee: Xerox Corporation, Stamford, Conn.

[21] Appl. No.: 47,903

[22] Filed: Apr. 19, 1993

[51] Int. Cl.[5] ..... G03G 9/097

[52] U.S. Cl. ..... 430/106.6; 430/110

[58] Field of Search ..... 430/110, 106.6

[56] References Cited

U.S. PATENT DOCUMENTS

| | | | |
|---|---|---|---|
| 4,206,064 | 6/1980 | Kiuchi et al. | 430/106 |
| 4,298,672 | 11/1981 | Lu | 430/108 |
| 4,411,974 | 10/1983 | Lu et al. | 430/106 |
| 4,845,003 | 7/1989 | Kiriu et al. | 430/110 |
| 5,023,158 | 6/1991 | Tomono et al. | 430/110 |
| 5,153,089 | 10/1992 | Ong et al. | 430/110 |
| 5,188,929 | 2/1993 | Ishii | 430/110 |
| 5,223,368 | 6/1993 | Ciccarelli et al. | 430/110 |
| 5,250,379 | 10/1993 | Bayley et al. | 430/110 |
| 5,250,380 | 10/1993 | Bayley et al. | 430/110 |
| 5,250,381 | 10/1993 | Ciccarelli et al. | 430/110 |

*Primary Examiner*—Christopher D. Rodee
*Attorney, Agent, or Firm*—E. O. Palazzo

[57] ABSTRACT

A negatively charged toner composition comprised of resin, colorants comprised of color dyes or pigment particles, optional surface additives, and an aluminum charge enhancing additive obtained from the reaction of aluminum ions with either four molar equivalents of an orthohydroxyphenol and a base, or two molar equivalents, each of an orthohydroxyphenol and a phenol, and a base.

27 Claims, No Drawings

TONER COMPOSITIONS WITH ALUMINUM NEGATIVE CHARGE ENHANCING ADDITIVES

BACKGROUND OF THE INVENTION

The invention is generally directed to toner and developer compositions, and more specifically, the present invention is directed to developer and toner compositions containing charge enhancing additives, which impart or assist in imparting a negative charge to the toner particles, and enable toners with rapid triboelectric charging characteristics, and excellent admix characteristics. In embodiments, there are provided in accordance with the present invention toner compositions comprised of toner resins, color pigment particles or dyes, and certain aluminum complex charge enhancing additives. In embodiments of the present invention, the charge additives are anionic aluminum complexes comprised of an anion of a central aluminum atom bonded to four ligands, and a counter cation of a proton, an alkaline metal ion, ammonium ion, or the like. In a specific embodiment of the present invention, the anion of the aluminum complex charge enhancing additive contains four identical ligands derived preferably from ortho-hydroxyphenols. The charge enhancing aluminum complexes of the present invention can generally be prepared by treating a mixture of an aqueous aluminum ion solution and two molar equivalents of an ortho-hydroxyphenol with two molar equivalents of a base, such as potassium hydroxide, sodium hydroxide, or an amine, followed by reacting the resulting intermediate with two molar equivalents of a phenol and a base. For the aluminum charge enhancing complexes with four identical ligands derived from ortho-hydroxyphenols, the synthesis involves simple treatment of an aqueous aluminum ion solution and four molar equivalents of ortho-hydroxyphenol with four molar equivalents of an appropriate base. The aforementioned charge additives in embodiments of the present invention enable, for example, toners with rapid triboelectric charging characteristics, extended developer life, stable triboelectrical properties irrespective of changes in environmental conditions, and high image print quality with substantially no background deposits. Also, the aforementioned toner compositions usually contain a colorant component comprised of, for example, carbon black, magnetites, or mixtures thereof, pigment particles like color pigments or dyes with cyan, magenta, yellow, blue, green, red, brown, or mixtures thereof thereby providing for the development and generation of black and/or colored images. The toner and developer compositions of the present invention can be selected for electrophotographic, especially xerographic, imaging and printing processes, including color processes.

Toners with negative charge additives are known, reference for example U.S. Pat. Nos. 4,411,974 and 4,206,064, the disclosures of which are totally incorporated herein by reference. The '974 patent discloses negatively charged toner compositions comprised of resins, pigment particles, and as a charge enhancing additive ortho-halophenyl carboxylic acids. Similarly, there are disclosed in the '064 patent toner compositions with chromium, cobalt, and nickel complexes of salicylic acid as negative charge enhancing additives. In U.S. Pat. No. 4,845,003, there are illustrated negatively charged toners with certain aluminum salt charge additives. More specifically, this patent discloses as charge additives aluminum complexes comprised of two or three hydroxybenzoic acid ligands bonded to a central aluminum ion. While these charge additives may have the capability of imparting negative triboelectric charge to toner particles, they are generally not as efficient in promoting the rate of triboelectric charging of toner particles. A fast rate of triboelectric charging is particularly important for high speed xerographic machines since, for example, these machines consume toner rapidly, and fresh toner has to be constantly added. The added uncharged toners, therefore, must charge up to their equilibruim triboelectric charge level rapidly to ensure no interruption in the xerographic imaging or printing operation. Another disadvantage of these charge additives is their thermal instability, that is they often break down during the thermal extrusion process of the toner manufacturing cycle. Additionally, the hydroxybenzoic acid ligands, particularly 3,5-di-tert-butylsalicylic acid, are expensive precursors for these additives. Most or many of these and other disadvantages are eliminated, or substantially eliminated with the metal complex charge additives of the present invention.

Developer compositions with charge enhancing additives, which impart a positive charge to the toner particles, are also well known. Thus, for example, there is described in U.S. Pat. No. 3,893,935 the use of quaternary ammonium salts as charge control agents for electrostatic toner compositions; U.S. Pat. No. 4,221,856 which discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example sulfate, sulfonate, nitrate, borate, chlorate, and the halogens such as iodide, chloride and bromide, reference the Abstract of the Disclosure and column 3; a similar teaching is presented in U.S. Pat. No. 4,312,933 which is a division of U.S. Pat. No. 4,291,111; similar teachings are presented in U.S. Pat. No. 4,291,112 wherein A is an anion including, for example, sulfate, sulfonate, nitrate, borate, chlorate, and the halogens; U.S. Pat. No. 4,338,390, the disclosure of which is totally incorporated herein by reference, discloses developer compositions containing as charge enhancing additives organic sulfate and sulfonates, which additives can impart a positive charge to the toner composition; and U.S. Pat. No. 4,298,672, the disclosure of which is totally incorporated herein by reference, discloses positively charged toner compositions with resins and pigment particles, and as charge enhancing additives alkyl pyridinium compounds.

Illustrated in U.S. Pat. No. 5,275,900 are toner compositions comprised of polymer resins, colorants comprised of color pigment particles or dye molecules, and certain metal complex charge additives derived from the reaction of a mixture of a hydroxybenzoic acid and a base with a metal ion in the presence of an excess of a hydroxyphenol. More specifically, this patent illustrates a negatively charged toner composition comprised of polymer, colorant, optional surface additives, and a metal complex charge enhancing additive of the following formula

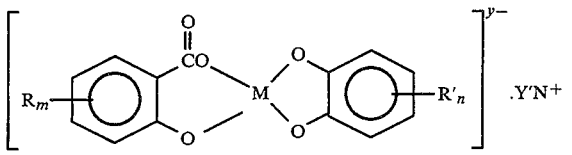

where M is a metal; N+ is a cation; R and R′ are alkyl, alkoxy, aryloxy, halogen, carbonyl, amino, nitro, or mixtures thereof; m and n are the number of R substituents ranging from 0 to 3; y− is the magnitude of the negative charge of the anion; and y′ represents the number of cations.

Illustrated in U.S. Pat. No. 5,300,387 is a negatively charged toner composition comprised of a polymer or polymers, pigment, and a metal complex charge enhancing additive as essentially represented by the following formula

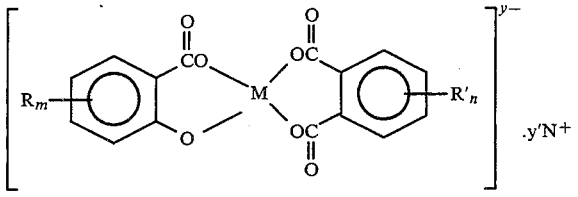

where M is the central metal ion; N+ is the counter cation; R and R′ are selected from the group consisting of alkyl, alkoxy, aryloxy, halogen, carbonyl group, alkoxycarbonyl group, amino group, nitro group or mixtures thereof; m and n are the number of R substituents on the aromatic rings, ranging from 0 to 3; y− is the magnitude of the negative charge of the anion or the number of the counter cations of the metal complex, and represents the number 1 or 2; and y′ represents the number of counter cations N+.

In another U.S. Pat. No. 5,238,768, toner compositions containing novel bis(hydroxyaryl) sulfone charge enhancing additives are disclosed.

Also, there is illustrated in U.S. Pat. No. 5,250,380 a negatively charged toner composition comprised of resin, pigment, and an aluminum charge enhancing additive of the following formula

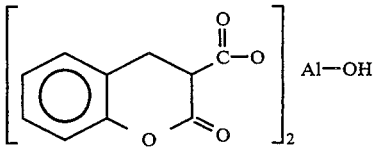

U.S. Pat. No. 5,250,379 a negatively charged toner composition comprised of resin, pigment, and an aluminum charge enhancing additive of the following formula

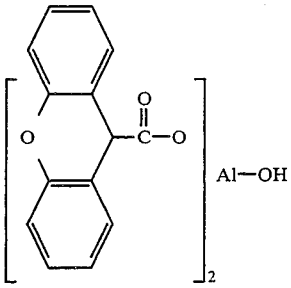

and copending application U.S. Ser. No. 964,544 a toner composition comprised of a polymer or polymers, pigment particles and/or dyes, optional surface additives, and a charge enhancing additive of the following formula

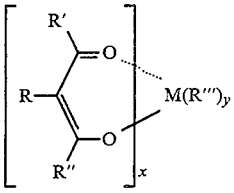

wherein R is hydrogen, alkyl, or aryl; R′ and R″ are selected from the group consisting of alkyl, alkoxy, aryl, and aryloxy; R‴ is selected from the group consisting of alkyl, alkoxy, oxide, and halide; M is boron or a metal; x is a number of from 1 to 4; and y is a number of from 0 to 2.

The disclosures of each of the copending applications are totally incorporated herein by reference.

Although many charge enhancing additives are known, there continues to be a need for charge enhancing additives which when selected for toners, render toners with many of the advantages illustrated herein. There is also a need for negative charge enhancing additives which are useful for incorporation into black and colored toner compositions which can be utilized for developing positive electrostatic latent images. Moreover, there is a need for colored toner compositions containing charge enhancing additives which do not interfere with the color quality of the colorants present in the toners. Another need relates to the provision of toner compositions with certain charge enhancing additives, which toners in embodiments thereof possess substantially stable triboelectric charge levels, and display acceptable rates of triboelectric charging characteristics. Furthermore, there is also a need for toner compositions with certain charge enhancing additives which possess excellent dispersibility characteristics in toner resins, and can, therefore, form stable dispersions in toner compositions. There is also a need for negatively charged black and colored toner compositions that are useful for incorporation into various imaging processes, inclusive of color xerography, as illustrated in U.S. Pat. No. 4,078,929, the disclosure of which is totally incorporated herein by reference; laser printers; and additionally a need for toner compositions useful in imaging apparatuses having incorporated therein layered photoresponsive imaging members, such as the members illustrated in U.S. Pat. No. 4,265,990, the disclosure of which is totally incorporated herein by reference. Also, there is a need for negatively charged toner compositions which have desirable triboelectric charge levels of, for example, from between about −10 to about −40 microcoulombs per gram, and triboelectric charging rates of less than about 120 seconds, and preferably less than 60 seconds, such as 30 seconds or less as measured by standard charge spectrograph methods when the toners are frictionally charged against suitable carrier particles via conventional roll milling techniques. There is also a need for nontoxic, substantially nontoxic, or environmentally compatible charge enhancing additives which when selected at effective concentrations of, for example, less than 7 weight percent, preferably less than 4 weight percent, render the resulting toners environmentally acceptable. An additional need resides in the provision of simple and cost-effective preparative processes for the charge enhancing additives of the present invention. The concentrations of the charge additives that can be present generally range from about 0.05 weight percent to about 5 weight percent, depending on whether the charge additive is utilized as a surface additive or as a dispersion in the bulk of the toner. The effective concentrations of toner in the developer, that is toner and carrier particles, are, for example, from about 0.5 to about 5 weight percent, and preferably from about 1 to about 3 weight percent.

SUMMARY OF THE INVENTION

It is an object of the present invention to provide toner and developer compositions with negative charge enhancing additives.

in another object of the present invention there are provided negatively charged toner compositions useful for the development of electrostatic latent images including color images.

In yet a further object of the present invention there may be provided, it is believed, humidity insensitive, from about, for example, 20 to 80 percent relative humidity at temperatures of from 60° to 80° F. as determined in a relative humidity testing chamber, negatively charged toner compositions with desirable triboelectric charging rates of less than 120 seconds, and preferably less than 60 seconds as determined by the charge spectrograph method, and acceptable triboelectric charging levels of from about −10 to about −40 microcoulombs per gram.

Another object of the present invention resides in the preparation of negatively charged toners which will enable the development of images in electrophotographic imaging apparatuses, which images have substantially no background deposits thereon, are substantially smudge proof or smudge resistant, and therefore, are of excellent resolution; and further, such toner compositions can be selected for high speed electrophotographic apparatuses, that is, for example, those exceeding 50 copies per minute.

A further object is to provide a simple and cost-effective preparative process for the charge enhancing additives.

These and other objects of the present invention may be accomplished in embodiments thereof by providing toner compositions comprised of toner resins, colorants comprised of color pigments or dye molecules, and an aluminum complex charge additive obtained either from the reaction of aluminum ion with two molar equivalents of an ortho-hydroxyphenol and an appropriate base such as potassium hydroxide, sodium hydroxide, or an amine, followed by reaction with two molar equivalents of a phenol and a base, or from the reaction of aluminum ion with four molar equivalents of an ortho-hydroxphenol and an appropriate base. More specifically, the present invention in embodiments is directed to toner compositions comprised of toner resins, color pigments, or dyes, and a negative charge enhancing additive which is believed to be represented by the formula

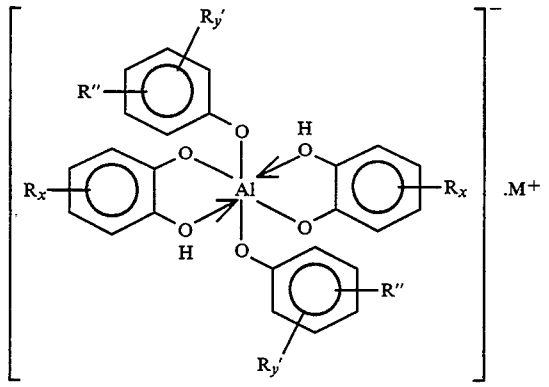

wherein R and R' are independently selected from the group consisting of hydrogen, alkyl, aryl, alkoxy, aryloxy, hydroxy, halogen, amino, cyano, nitro, and the like; R'' is hydrogen, or hydroxy; M+ is a proton, an ammonium ion, a substituted ammonium ion or a metal cation; and x and y are numbers of, for example, 1 or 2.

Examples of alkyl, and alkoxy include those with 1 to about 10 carbon atoms, such as methyl, methoxy, ethyl, ethoxy, propyl, propoxy, butyl, butoxy, pentyl, pentoxy, hexyl, hexoxy, heptyl, heptoxy, and the like. Aryloxy includes phenoxy, methylphenoxy, chlorophenoxy, and the like. Halogen includes fluorine, chlorine, bromine, and iodine. Examples of M+ include $R_4N^+$, $R_3HN^+$, $R_2H_2N^+$, $RH_3N^+$, $NH_4^+$, $Li^+$, $Na^+$, $K^+$, $Cs^+$ wherein R is an alkyl group such as methyl, ethyl, propyl, butyl and the like.

The aforementioned charge additives can be incorporated into the toner, may be present on the toner surface or may be present on toner surface additives such as colloidal silica particles. Advantages of rapid triboelectric charging characteristics of generally less than 120 seconds, and preferably less than 60 seconds in embodiments as measured by the standard charge spectrograph methods when the toners are frictionally charged against carrier particles by known conventional roll mixing methods, appropriate triboelectric charge levels, and the like can be achieved with many of the aforementioned toners of the present invention. In another embodiment of the present invention, there are provided, subsequent to known micronization and classification, toner particles with a volume average diameter of from about 3 to about 15 microns.

Examples of charge additives of the present invention are represented by the following formulas

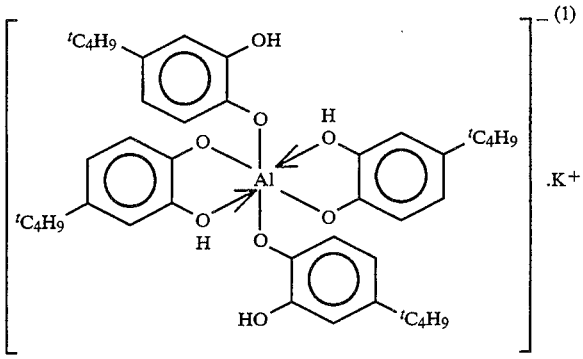
(1)
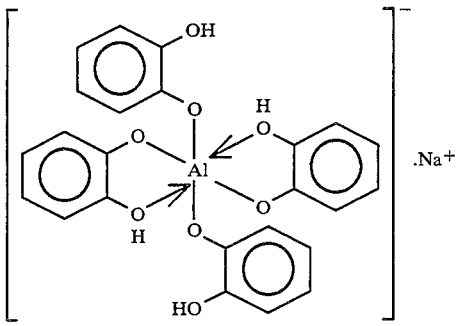
(2)
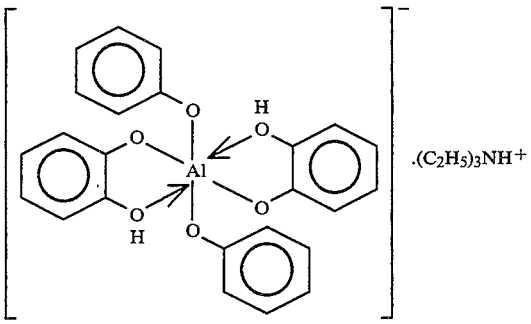
(3)
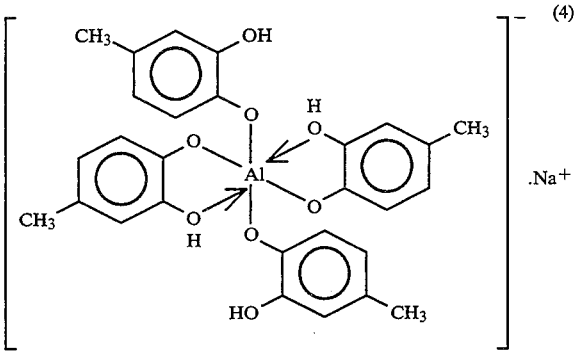
(4)
-continued
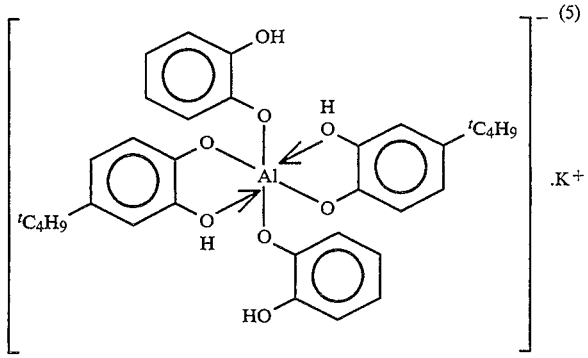
(5)
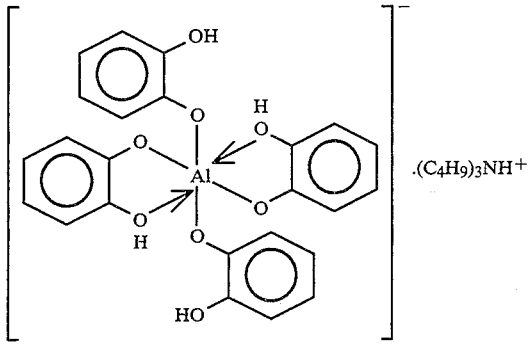
(6)
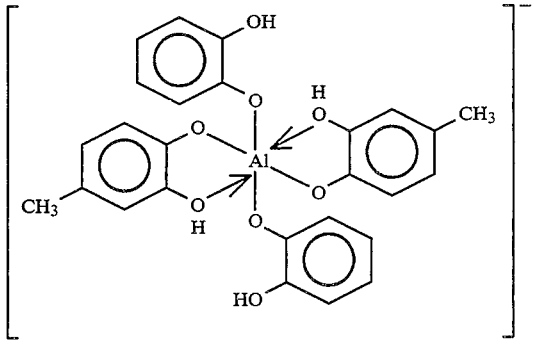
(7)
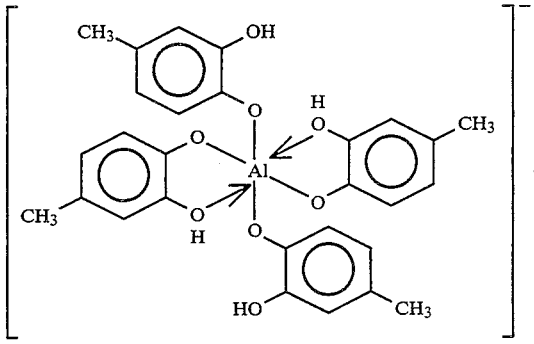
(8)

-continued

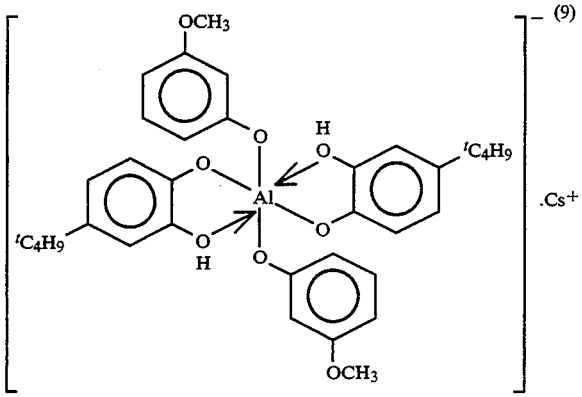

(9)

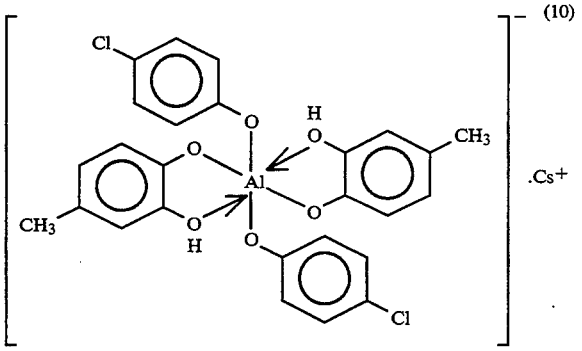

(10)

The aluminum complex charge additives of the present invention can be prepared by the treatment of an aqueous aluminum ion solution containing two molar equivalents of an ortho-hydroxyphenol with two molar equivalents of a base, such as potassium hydroxide, sodium hydroxide, or an amine, followed by reacting the resulting intermediate with two molar equivalents of a phenol and a base; and for those aluminum charge enhancing complexes with four identical ligands derived from ortho-hydroxyphenols, the synthesis involves the reaction of an aqueous aluminum ion solution containing four molar equivalents of an ortho-hydroxyphenol with four molar equivalents of an appropriate base. The reaction is generally accomplished at a temperature ranging from ambient to the refluxing temperature of the reaction medium for a duration ranging from 15 minutes to over 10 hours. More specifically, the preparation involves the dropwise addition of an aqueous base to an aqueous mixture of one molar equivalent of aluminum ion and two molar equivalents of an ortho-hydroxyphenol over a period ranging from 10 minutes to two hours, followed by addition of two molar equivalents of a phenol, and then the dropwise addition of another two molar equivalents of an aqueous base. After the reaction, the resulting aluminum complex precipitate is filtered and washed with water or a dilute aqueous base. In embodiments of the present invention, the aluminum complexes obtained may contain a mixture of a proton and an alkali or alkali earth metal ion, or ammonium ion as the counter cations. In another specific embodiment, the present invention is directed to aluminum complex charge enhancing additives containing four similar or identical ligands derived from orthohydroxyphenol.

The toner compositions of the present invention can be prepared by a number of known methods such as admixing and heating toner resins such as styrene butadiene copolymers, colorants such as color pigment particles or dye compounds, and the aforementioned aluminum complex charge enhancing additive, or mixtures of charge additives in a concentration, preferably ranging from about 0.5 percent to about 5 percent, in a toner extrusion device, such as the ZSK53 available from Werner Pfleiderer, and removing the resulting toner composition from the device. Subsequent to cooling, the toner composition is subjected to grinding utilizing, for example, a Sturtevant micronizer for the purpose of achieving toner particles with a volume average diameter of from about 3 to about 15 microns, and preferably from about 3 to about 10 microns, which diameters are determined by a Coulter Counter. Subsequently, the toner compositions can be classified utilizing, for example, a Donaldson Model B classifier for the purpose of removing unwanted fine toner particles.

Illustrative examples of suitable toner resins selected for the toner and developer compositions of the present invention include vinyl polymers such as styrene polymers, acrylonitrile polymers, vinyl ether polymers, acrylate and methacrylate polymers; epoxy polymers; polyurethanes; polyamides; polyimides; polyesters; and the like. The toner resins selected for the toner compositions of the present invention include homopolymers or copolymers of two or more monomers. Furthermore, the above mentioned polymer resins may also be crosslinked depending on the desired toner properties. Illustrative vinyl monomer units in the vinyl polymers include styrene, substituted styrenes such as methyl styrene and chlorostyrene, methyl acrylate and methacrylate, ethyl acrylate and methacrylate, propyl acrylate and methacrylate, butyl acrylate and methacrylate, pentyl acrylate and methacrylate, butadiene, vinyl chloride, acrylonitrile, acrylamide, alkyl vinyl ether and the like. Illustrative examples of the dicarboxylic acid units in the polyester resins suitable for use in the toner compositions of the present invention include phthalic acid, terephthalic acid, isophthalic acid, succinic acid, glutaric acid, adipic acid, pimelic acid, suberic acid, azelaic acid, sebacic acid, maleic acid, fumaric acid, dimethyl glutaric acid, bromoadipic acids, dichloroglutaric acids, and the like; while illustrative examples of the diol units in the polyester resins include ethanediol, propanediols, butanediols, pentanediols, pinacol, cyclopentanediols, hydrobenzoin, bis(hydroxyphenyl)alkanes, dihydroxybiphenyl, and the like.

As one toner resin, there are selected polyester resins derived from a dicarboxylic acid and a diphenol. These resins are illustrated in U.S. Pat. No. 3,590,000, the disclosure of which is totally incorporated herein by reference; polyester resins obtained from the reaction of bisphenol A and propylene oxide, followed by the reaction of the resulting diol with fumaric acid, and branched polyester resins resulting from the reaction of dimethylterephthalate with a mixture of 1,3-butanediol, 1,2-propanediol, and pentanetriol. Further, low melting crosslinked polyesters, especially those prepared by reactive extrusion, reference U.S. Ser. No. 914,641 U.S. Pat. No. 5,227,460, the disclosures of which are totally incorporated herein by reference, can be selected as toner resins. Other specific toner resins include styrene-methacrylate copolymers, and styrene-butadiene copolymers; PLIOLITES®; suspension polymerized styrene-butadienes, reference U.S. Pat. No. 4,558,108, the disclosure of which is totally incorporated herein by reference. Also, waxes with a molecular weight of from about 1,000 to about 6,000, such as polyethylene, polypropylene, and paraffin waxes, can be included in, or on the toner compositions as fuser roll release agents.

The toner resins are present in a sufficient and effective amount of, for example, from about 30 to about 95 weight percent. Thus, when 1 percent by weight of the charge enhancing additive is present, and 10 percent by weight of colorant, such as carbon black or color pigment, is contained therein, about 89 percent by weight of toner resin is selected. Also, the charge enhancing additive of the present invention may be applied as a surface coating on the toner particles. When used as a coating, the charge enhancing additive of the present invention is present in an amount of from about 0.05 weight percent to about 5 weight percent, and preferably from about 0.1 weight percent to about 1.0 weight percent.

Numerous well known suitable color pigments or dyes can be selected as the colorant for the toner compositions including, for example, carbon black such as REGAL 330®, nigrosine dye, metal phthalocyanines, aniline blue, magnetite, or mixtures thereof. The colorant, which is preferably carbon black, should be present in a sufficient amount to render the toner composition with a sufficiently high color intensity. Generally, the colorants are present in amounts of from about 1 weight percent to about 20 weight percent, and preferably from about 2 to about 10 weight percent based on the total weight of the toner composition; however, lesser or greater amounts of colorant can be selected.

When the colorants are comprised of magnetites or a mixture of magnetites and other pigment particles, thereby enabling single component toners and toners for magnetic ink character recognition (MICR) applications in some instances, which magnetites are a mixture of iron oxides ($FeO.Fe_2O_3$) including those commercially available as MAPICO BLACK®, they are present in the toner composition in an amount of from about 5 weight percent to about 70 weight percent, and preferably in an amount of from about 10 weight percent to about 50 weight percent. Mixtures of carbon black and magnetite with from about 1 to about 15 weight percent of carbon black, and preferably from about 2 to about 6 weight percent of carbon black, and magnetite, such as MAPICO BLACK®, in an amount of, for example, from about 5 to about 70, and preferably from about 10 to about 50 weight percent can be selected for black toner compositions of the present invention.

There can also be blended with the toner compositions of the present invention external additives including flow aid additives, which additives are usually present on the surface thereof. Examples of these additives include colloidal silicas such as AEROSIL®, metal salts and metal salts of fatty acids inclusive of zinc stearate, aluminum oxides, cerium oxides, titanium oxides, and mixtures thereof, which additives are generally present in an amount of from about 0.1 percent by weight to about 5 percent by weight, and preferably in an amount of from about 0.5 percent by weight to about 2 percent by weight. Several of the aforementioned additives are illustrated in U.S. Pat. Nos. 3,590,000 and 3,800,588, the disclosures of which are totally incorporated herein by reference.

With further respect to the present invention, colloidal silicas, such as AEROSIL®, can be surface treated with the metal complex charge additives of the present invention illustrated herein in an amount of from about 1 to about 50 weight percent and preferably 10 weight percent to about 25 weight percent, followed by the addition thereof to the toners in an amount of from 0.1 to 10 and preferably 0.1 to 5 weight percent.

Also, there can be included in or on the toner compositions of the present invention low molecular weight waxes, such as polypropylenes and polyethylenes commercially available from Allied Chemical and Petrolite Corporation, EPOLENE N-15 TM commercially available from Eastman Chemical Products, Inc., VISCOL 550-P TM, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 6,000 in embodiments. Many of the polyethylene and polypropylene compositions useful in the present invention are illustrated in British Patent No. 1,442,835, the disclosure of which is totally incorporated herein by reference. These low molecular weight wax materials are present in the toner composition of the present invention in various amounts, however, generally these waxes are present in the toner composition in an amount of from about 1 percent by weight to about 15 percent by weight, and preferably in an amount of from about 2 weight percent to about 10 weight percent.

Included within the scope of the present invention are colored toner and developer compositions comprised of toner resins, optional carrier particles, the charge enhancing additives illustrated herein, and as colorants red, blue, green, brown, magenta, cyan and/or yellow dyes or color pigments, as well as mixtures thereof. More specifically, with regard to the generation of color images utilizing a developer composition with the charge enhancing additives of the present invention, illustrative examples of magenta materials that may be selected as colorants include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as colorants include copper phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, and Permanent Yellow FGL. The aforementioned colorants are incorporated into the toner composition in various suitable effective amounts providing the objectives of the present invention are achieved. In one embodiment, these colorants are present in the toner composition in an amount of from about 1 percent by weight to about 15 percent by weight based on the total weight of the toner.

For the formulation of developer compositions, there are mixed with the toner particles carrier components, particularly those that are capable of triboelectrically assuming an opposite polarity to that of the toner composition. Accordingly, the carrier particles of the present invention are selected to be those that would render the toner particles negatively charged while acquiring a positive charge polarity themselves via frictional charging against the toner particles of the present invention. The opposite charge polarities of the carrier and toner particles of the developer composition thus ensure the toner particles to adhere to and surround the carrier particles. Illustrative examples of carrier particles include iron powder, steel, nickel, iron, ferrites, including copper zinc ferrites, nickel zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxysilane, reference U.S. Pat. Nos. 3,526,533 and 3,467,634, the disclosures of which are totally incorporated herein by reference; polymethylmethacrylates; other known coatings; and the like. The carrier particles may also include in the coating, which coating can be present in one embodiment in an amount of from about 0.1 to about 3 weight percent, conductive substances such as carbon black in an amount of from about 5 to about 30 percent by weight. Polymer coatings not in close proximity in the triboelectric series can also be selected, reference U.S. Pat. Nos. 4,937,166 and 4,935,326, the disclosures of which are totally incorporated herein by reference, including for example KYNAR® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 1,000, and preferably from between about 80 and 200 microns in volume average diameter thereby permitting them, for example, to possess sufficient density and inertia to avoid adherence to the electrostatic images during the development process. The carrier component can be mixed with the toner composition in various suitable combinations, such as about 1 to 5 parts of toner to about 100 parts to about 200 parts by weight of carrier.

The toner composition of the present invention can be prepared by a number of known methods including extrusion melt blending the toner resins, colorants, and the complex charge enhancing additive of the present invention as indicated herein, followed by mechanical attrition and classification. Other methods include those well known in the art such as spray drying, melt dispersion, extrusion processing, dispersion polymerization, and suspension polymerization. Also, as indicated herein the toner composition without the charge enhancing additive can be first prepared, followed by addition of the charge enhancing additives and other optional surface additives, or the charge enhancing additive-treated surface additives such as colloidal silicas. Further, other methods of preparation for the toner are as illustrated herein.

The toner and developer compositions of the present invention may be selected for use in electrostatographic imaging apparatuses containing therein conventional photoreceptors providing that they are capable of forming positive electrostatic latent images relative to the triboelectric charge polarity of the toners.

The toners of the present invention are usually jetted and classified subsequent to preparation to enable toner particles with a preferred volume average diameter of from about 3 to about 15 microns. The triboelectric charging rates for the toners of the present invention are preferably less than 120 seconds and more specifically less than 60 seconds, such as 15 to 30 seconds, in embodiments thereof as determined by the known charge spectrograph method as described hereinbefore. These toner compositions with rapid rates of triboelectric charging characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 50 copies per minute.

The following Examples are being supplied to further illustrate various embodiments of the present invention, it being noted that these Examples are intended to illustrate and not limit the scope of the present invention. The products obtained can be identified by a number of known methods such as elemental analysis. Comparative Examples are also presented.

EXAMPLE I

The following procedure describes the preparation of the aluminum charge enhancing additive, potassium tetrakis(4-tert-butylcatecholato)aluminum (III), (1).

A mixture of 8.33 grams (0.0125 mole) of aluminum sulfate octadecahydrate [$Al_2(SO_4)_3.18\ H_2O$] and 16.62 grams (0.10 mole) of 4-tert-butylcatechol in 100 milliliters of water was mechanically stirred and heated to 85° to 90° C. in a 500 milliliter round-bottomed flask fitted with a water condenser. A solution of 6.60 grams (0.10 mole) of potassium hydroxide (85 percent pure) in 150 milliliters of water was added dropwise at a rate of about 2 milliliters per minute. The reaction mixture turned milky as the addition proceeded, and a greyish precipitate formed toward the end of addition. After the addition, the reaction mixture was stirred at the same temperature for another 2 hours before cooling down to about 65° C., and then filtered. The filter cake was washed with 100 milliliters of dilute aqueous potassium hydroxide solution (0.5 gram/liter of KOH), and then dried in vacuo at 75° C. for 36 hours. The yield of the above aluminum complex product was 83.9 percent.

EXAMPLE II

An aluminum charge enhancing additive, sodium tetrakis(4-methylcatecholato)aluminum (III), (4), was prepared in accordance with the procedure of Example I except 12.42 grams (0.10 mole) of 4-methylcatechol and 4.0 grams (0.10 mole) of sodium hydroxide were employed in place of respectively, 4-tert-butylcatechol and potassium hydroxide. The precipitate obtained after the reaction was washed with a dilute aqueous sodium hydroxide solution instead of an aqueous potassium hydroxide solution. The yield of the aluminum complex product was 87.4 percent.

EXAMPLE III

The following procedure details the preparation of the aluminum charge enhancing additive, potassium bis(4-methylcatecholato)bis(catecholato)aluminum (III), (7).

A mixture of 8.33 grams (0.0125 mole) of aluminum sulfate octadecahydrate [$Al_2(SO_4)_3.18\ H_2$] and 6.21 grams (0.05 mole) of 4-methylcatechol in 100 milliliters of water was mechanically stirred and heated to 85° to 90° C. in a 500 milliliter round-bottomed flask fitted with a water condenser. A solution of 3.30 grams (0.05 mole) of potassium hydroxide (85 percent pure) in 75 milliliters of water was added dropwise at a rate of about 2 milliliters per minute. The reaction mixture was continuously stirred at the same temperature for one hour before 5.51 grams (0.05 mole) of catechol were added. Subsequently, another aqueous solution of 3.30 grams (0.05 mole) of potassium hydroxide (85 percent pure) in 75 milliliters of water was added in the manner described above. After another hour of stirring, the reaction mixture was cooled down to 65° C. and then filtered. The filter cake was washed with 100 milliliters of dilute aqueous potassium hydroxide solution (0.5 gram/liter of KOH), and then dried in vacuo at 75° C. for 36 hours. The yield of the above aluminum complex product was 82.8 percent.

EXAMPLE IV

There was prepared in an extrusion device, available as ZSK-30 from Werner Pfleiderer, a toner composition by adding thereto 94.0 weight percent of a suspension polymerized styrene butadiene resin, reference U.S. Pat. No. 4,558,108, the disclosure of which is totally incorporated herein by reference, and 6.0 weight percent of REGAL 330 ® carbon black. The toner composition was extruded at a rate of 20 pounds per hour at a temperature of about 130° C. with a screw speed of 200 rpm. The strands of melt mixed product exiting from the extruder were air cooled, pelletized in a Berlyn Pelletizer and then fitzmilled in a Model J Fitzmill. The toner product was then subjected to grinding in a Sturtevant micronizer. Thereafter, the aforementioned toner particles were classified in a Donaldson Model B classifier for the purpose of removing fine particles, that is those with a volume average diameter of less than 4 microns. The resulting toner had a volume average particle diameter of 10.6 microns, and a particle size distribution of 1.22 as measured by a Coulter Counter. Subsequently, the toner was surface-coated with 0.25 weight percent of the aluminum charge enhancing additive of Example I by blending in a small commercial coffee blender for 30 to 60 seconds.

The above treated toner was equilibrated at room temperature, about 25° C., under a 50 percent relative humidity condition for 24 hours. A developer was then prepared by blending 2.0 weight percent of the surface-treated toner with 98.0 weight percent of a carrier containing a nickel zinc ferrite core and 0.9 weight percent of polymer composite coating comprised of 80 weight percent of a methyl terpolymer, a styrene, butylacrylate, organosilane terpolymer, and 20 weight percent of VULCAN XC72 ® carbon black. The methyl terpolymer is comprised of about 81 weight percent of polymethyl methacrylate and 19 weight percent of a styrene vinyltriethoxysilane polymer. The developer was roll milled for 30 minutes to generate the time zero developer, and the triboelectric charge of the toner of the resulting developer was measured to be −11.5 microcoulombs per gram by the standard known blow-off technique in a Faraday Cage apparatus. To measure the rate of triboelectric charging of toner, 1.0 weight percent of the uncharged toner was added to the time zero developer, and the charge distribution of the toner of the resulting developer was measured as a function of the blending time via roll milling using a charge spectrograph. The time required for the toner of the resulting developer to attain a charge distribution similar to that of the toner of the time zero developer was taken to be the rate of charging of the toner. For this toner, the rate of charging was about 30 seconds.

COMPARATIVE EXAMPLE (A)

A comparative black toner with a commercial charge enhancing additive, BONTRON E-88 TM, an aluminum salt obtained from Hodogaya Chemicals of Japan, and believed to be tris(3,5-di-tertiarybutylsalicylato)aluminum was prepared by blending the untreated toner of Example IV with 0.25 weight percent of BONTRON E-88 TM, and a developer was then prepared from this toner in accordance with the procedure of Example IV. The toner exhibited a triboelectric charge of −40.4 microcoulombs per gram, and its rate of charging or admix was measured by the charge spectrograph to be about 5 minutes.

EXAMPLE V

A black toner was prepared in accordance with the procedure of Example IV utilizing 0.25 weight percent of aluminum complex charge enhancing additive of Example II in place of that of Example I. A developer was then prepared from this toner in accordance with the procedure of Example IV. The resulting toner had a triboelectric charge of −13.5 microcoulombs per gram, and a rate of charging of about 30 seconds.

EXAMPLE VI

A black toner was prepared in accordance with the procedure of Example IV using 0.25 weight percent of the aluminum charge enhancing additive of Example III instead of that of Example I. A developer was then prepared from this toner in accordance with the procedure of Example IV. The toner displayed a triboelectric charge of −14.2 microcoulombs per gram, and its rate of charging was measured to be about 30 seconds.

EXAMPLE VII

A blue toner comprised of 94.0 weight percent of SPAR II polyester resin, 2.0 weight percent of PV FAST BLUE TM pigment, and 4.0 weight percent of the aluminum complex charge enhancing additive of Example II was prepared by melt blending these three components, followed by micronizing and classifying in accordance with the procedure of Example IV. The resulting toner had a volume average particle diameter of 10.2 microns, and a particle size distribution of 1.26. A developer was prepared with this toner using 2.0 weight percent of toner and a carrier containing a steel core and 0.8 weight percent of a polymer composite coating comprised of 80 weight percent of polymethyl methacrylate and 20 weight percent of VULCAN XC72 ® carbon black. The toner displayed a triboelectric charge of −10.2 microcoulombs per gram, and its rate of charging was measured by the charge spectrograph throughout unless otherwise indicated to be about 60 seconds.

The toner was then surface coated with 0.4 weight percent of AEROSIL R972 ® by a conventional dry blending method, and a developer was prepared from this toner and the above carrier particles. The triboelectric charge of this toner was measured to be −11.6 microcoulombs per gram, and its rate of charging was 30 seconds.

COMPARATIVE EXAMPLE (D)

A comparative blue toner and developer composition with the charge additive, BONTRON E-88 TM, available from Hodogaya Chemicals of Japan, were prepared in accordance with the procedure of Example VII except that BONTRON E-88 TM was utilized in place of the aluminum complex charge additive of Example II. The toner displayed a triboelectric charge of −13.7 microcoulombs per gram, and its rate of charging was about 5 minutes.

COMPARATIVE EXAMPLE (E)

Another comparative blue toner and developer were prepared using the available charge additive, BONTRON E-84 TM, in a similar manner to Example (D). The triboelectric charge of this toner was −15.5 microcoulombs per gram, and its rate of charging was 15 minutes.

Other modifications of the present invention may occur to those skilled in the art subsequent to a review of the present application, and these modifications, including equivalents thereof, are intended to be included within the scope of the present invention.

What is claimed is:

1. A negatively charged toner composition consisting essentially of resin, colorants comprised of color dyes or pigment particles, optional surface additives, and an aluminum charge enhancing additive obtained from the reaction of aluminum ions with either four molar equivalents of an ortho-hydroxyphenol and a base, or two molar equivalents, each of an ortho-hydroxyphenol and a phenol, and a base.

2. A toner composition in accordance with claim 1 wherein the charge additive is present in an amount of from about 0.05 to about 5 weight percent.

3. A toner composition in accordance with claim 1 wherein the charge additive is present in an amount of from about 0.1 to about 3 weight percent.

4. A toner composition in accordance with claim 1 wherein the toner's rate of charging is less than about 60 seconds when toner charging is accomplished by friction against carrier particles via roll milling.

5. A toner composition in accordance with claim 1 with a negative triboelectric charge of from between about −10 to about −40 microcoulombs per gram.

6. A toner composition in accordance with claim 1 wherein the resin is comprised of styrene polymers, acrylic or methacrylic polymers, polyesters, or mixtures thereof.

7. A toner composition in accordance with claim 1 wherein the resin is comprised of styrene acrylates, styrene methacrylates, or styrene butadienes.

8. A toner composition in accordance with claim 1 wherein the surface additives are metal salts of a fatty acid, colloidal silicas, or mixtures thereof.

9. A toner composition in accordance with claim 1 wherein the colorants are carbon black, magnetites, or mixtures thereof, cyan, magenta, yellow, red, blue, green, brown, and mixtures thereof.

10. A negatively charged toner composition consisting essentially of resin or resins, pigment particles, optional surface additives, and an aluminum charge enhancing additive represented by the following formula

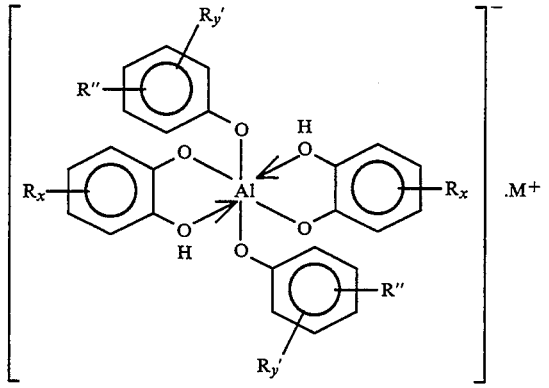

wherein R and R' are independently selected from the group consisting of hydrogen, alkyl, aryl, alkoxy, aryloxy, hydroxy, halogen, amino, cyano, and nitro; R'' is hydrogen or hydroxy; M+ is a proton, an ammonium ion, a substituted ammonium ion or a metal cation; and x and y are the numbers 1 or 2.

11. A toner composition in accordance with claim 10 wherein the counter cation M+ is selected from the group consisting of a proton, a lithium ion, a sodium ion, a potassium ion, a cesium ion, an ammonium ion and a substituted ammonium ion.

12. A toner composition in accordance with claim 10 wherein R'' is a hydroxy group.

13. A toner composition in accordance with claim 10 wherein the substituents R and R' are tertiary butyl groups.

14. A toner composition in accordance with claim 10 wherein the charge additive is coated on or impregnated in colloidal silica particles.

15. A toner composition in accordance with claim 10 wherein the pigment particles are carbon black, magnetites, or mixtures thereof, cyan, magenta, yellow, red, blue, green, brown, and mixtures thereof.

16. A toner composition in accordance with claim 10 wherein the charge additive is present in an amount of from about 0.05 to about 5 weight percent.

17. A toner composition in accordance with claim 10 wherein the resin or resins are comprised of styrene polymers, acrylic or methacrylic polymer, polyesters, or mixtures thereof.

18. A toner composition in accordance with claim 10 wherein styrene polymers or polyesters are selected as the resin.

19. A toner in accordance with claim 10 wherein the charge additive is potassium, sodium or cesium tetrakis(catecholato)aluminum (III); potassium, sodium, cesium or substituted ammonium bis(alkylphenolato)-bis(alkylcatecholato)aluminum (III); potassium, sodium, cesium or substituted ammonium bis(4-methylcatecholato)-bis(4-tertiary-butylcatecholato)aluminum (III); potassium, sodium, cesium or substituted ammonium bis(catecholato)-bis(4-tertiary-butylcatecholato)aluminum (III); or potassium, sodium, cesium or ammonium bis(catecholato)-bis(4-methylcatecholato)aluminum (III).

20. A toner in accordance with claim 10 wherein the charge additive is potassium, sodium or cesium tetrakis(4-methylcatecholato)aluminum (III), or potassium, sodium or cesium tetrakis(4-tertiary-butylcatecholato)aluminum (III).

21. A toner in accordance with claim 10 wherein the charge additive is trialkylammonium tetrakis(4-methylcatecholato)aluminum (III) with the alkyl group being selected from the group consisting of methyl, ethyl, propyl, butyl, pentyl, hexyl, heptyl and octyl; trialkylammonium tetrakis(4-tertiary-butylcatecholato)aluminum (III) with the alkyl group being selected from the group consisting of methyl, ethyl, propyl, butyl, pentyl, hexy, heptyl and octyl; or trialkylammonium tetrakis(catecholato)aluminum (III) with the alkyl group being selected from the group consisting of methyl, ethyl, propyl, butyl, pentyl, hexyl hexy, heptyl and octyl.

22. A toner in accordance with claim 10 wherein alkyl or alkoxy contains from 1 to about 10 carbon atoms, and aryloxy contains from 6 to about 24 carbon atoms.

23. A developer composition consisting essentially of a negatively charged toner consisting essentially of resin, pigment particles, optional surface additives, and an aluminum charge enhancing additive obtained from the reaction of aluminum ions with either four molar equivalents of an orthohydroxyphenol and a base, or two molar equivalents, each of an orthohydroxyphenol and a phenol, and a base; and carrier particles.

24. A developer composition consisting essentially of a negatively charged toner composition comprised of resin or resins, pigment particles, optional surface additives, and an aluminum charge enhancing additive represented by the following formula

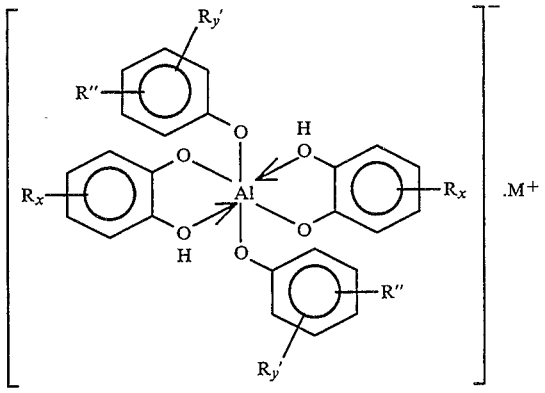

wherein R and R′ are independently selected from the group consisting of hydrogen, alkyl, aryl, alkoxy, aryloxy, hydroxy, halogen, amino, cyano, and nitro; R″ is hydrogen or hydroxy; M+ is a proton, an ammonium ion, a substituted ammonium ion or a metal cation; and x and y are the numbers 1 or 2; and carrier particles.

25. A developer composition in accordance with claim 24 wherein the carrier particles are comprised of ferrites, steel, or an iron powder with a polymer, or mixtures of polymers, coating thereover.

26. A developer composition in accordance with claim 25 wherein the coating is comprised of a methyl terpolymer, a polyvinylidine fluoride, a polymethyl methacrylate, or a mixture of polymers not in close proximity thereto in the triboelectric series.

27. A negatively charged toner composition consisting of resin, pigment and an aluminum charge enhancing additive represented by the following formula

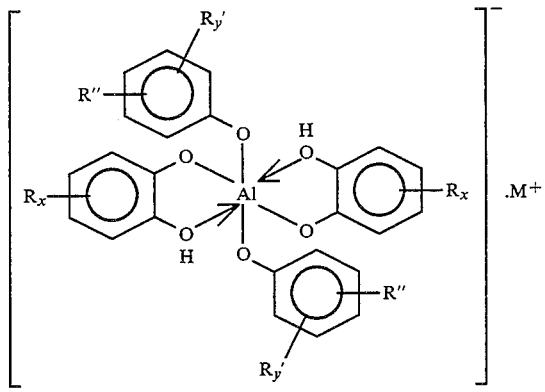

wherein R and R′ are independently selected from the group consisting of hydrogen, alkyl, aryl, alkoxy, aryloxy, hydroxy, halogen, amino, cyano, and nitro; R″ is hydrogen or hydroxy; M+ is a proton, an ammonium ion, a substituted ammonium ion or metal cation; and x and y are the numbers 1 or 2.

* * * * *